United States Patent [19]

Dlugolecki et al.

[11] Patent Number: 4,922,770

[45] Date of Patent: May 8, 1990

[54] ADJUSTABLE PLIERS

[75] Inventors: Andrzej J. Dlugolecki, Milwaukee; Timm R. Herman, Kenosha, both of Wis.

[73] Assignee: American Pneumatic Technologies, Inc., O'Fallon, Mo.

[21] Appl. No.: 194,408

[22] Filed: May 16, 1988

[51] Int. Cl.[5] ..... B25B 7/12

[52] U.S. Cl. ..... 81/357; 81/358; 81/325

[58] Field of Search ..... 81/355, 356, 357 OR, 81/342, 358 R, 359, 360, 364, 341, 318, 323, 325, 328

[56] References Cited

U.S. PATENT DOCUMENTS 2,531,285 11/1950 Manspeaker .
4,662,252 5/1987 Warheit ..... 81/341

FOREIGN PATENT DOCUMENTS 969920 7/1958 Fed. Rep. of Germany .
2456592 5/1979 France .

*Primary Examiner*—Frederick R. Schmidt
*Assistant Examiner*—Lawrence Cruz
*Attorney, Agent, or Firm*—Kalish & Gilster

[57] ABSTRACT

A self-locking pliers provides automatic jaw adjustment for gripping objects of different sizes. First and second pinsers-defining members each have a body portion, a jaw-defining portion and a handle portion, being joined by a bolt extending through a slot in one of the members in pivotal, mutually moveable relationship. The slot permits pivoting as well as sliding movement of the first member relative to the second member, and has along a jaw-proximate side teeth to be engaged by corresponding teeth of a locking pawl carried rotatably within the slot by a shank of the bolt. A jaw-remote side of the slotted opening provides a smooth surface for sliding engagement of a smooth reaction surface of the locking pawl opposite from its teeth. The locking pawl has on its jaw-proximate side a camming surface proximate to the locking teeth. A control arm is pivotally engaged at one end to the body portion of the second member. The body portion of the first member receives the other end of the control arm in slidably captive relationship, while a spring carried by the second member resiliently biases the control arm for movement about its pivoted end toward the jaws. The control arm initially causes the locking pawl reaction surface to bear against the jaw-remote side of the slot, so that squeezing the handles causes jaw-closing movement of the jaws until they close upon an object until contacted by the jaws. Such jaw contact the jaws causes the pawl to rotate within the slot for forcing its teeth into locking engagement with the rack for maintaining the jaws in locked, object-contacting relationship while handle pressure is maintained by the user. An interference-providing arrangement including a detent for the control arm provides controlled pawl engagement of the toothed rack and avoids "hanging up" the pawl or its inadvertent engagement.

24 Claims, 1 Drawing Sheet

FIG. 1
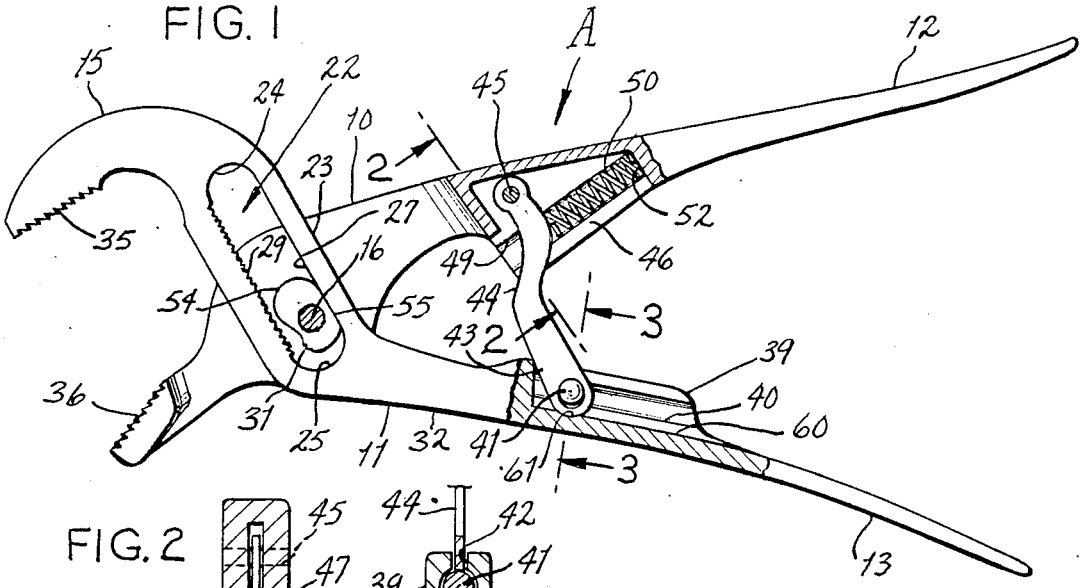
FIG. 2
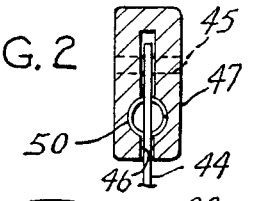
FIG. 3
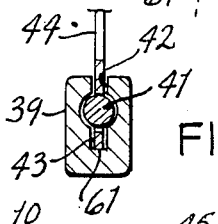
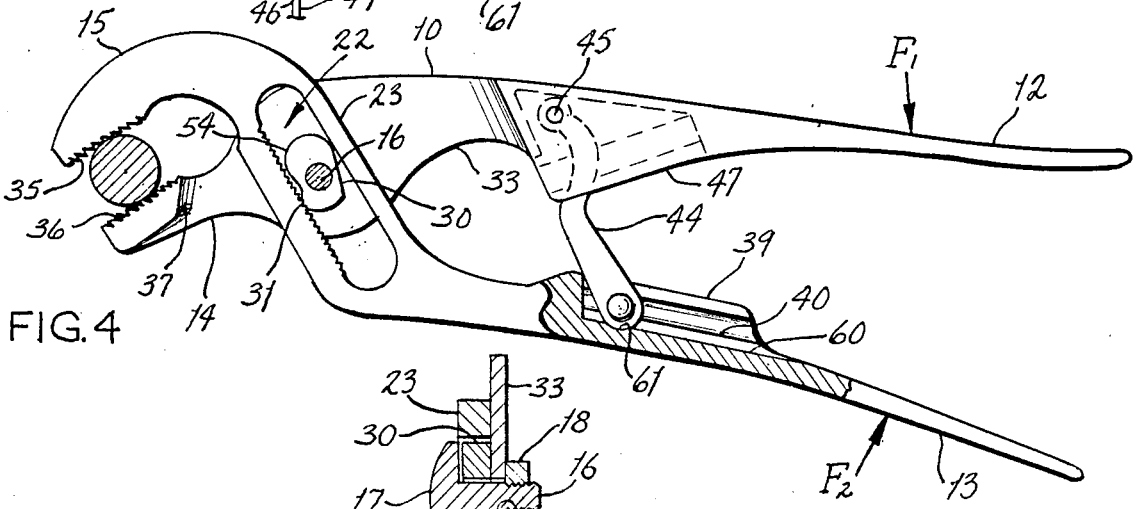
FIG. 4
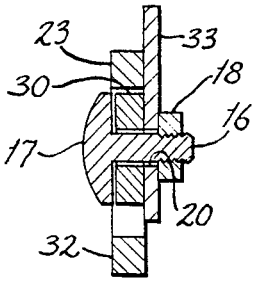
FIG. 6
FIG. 5
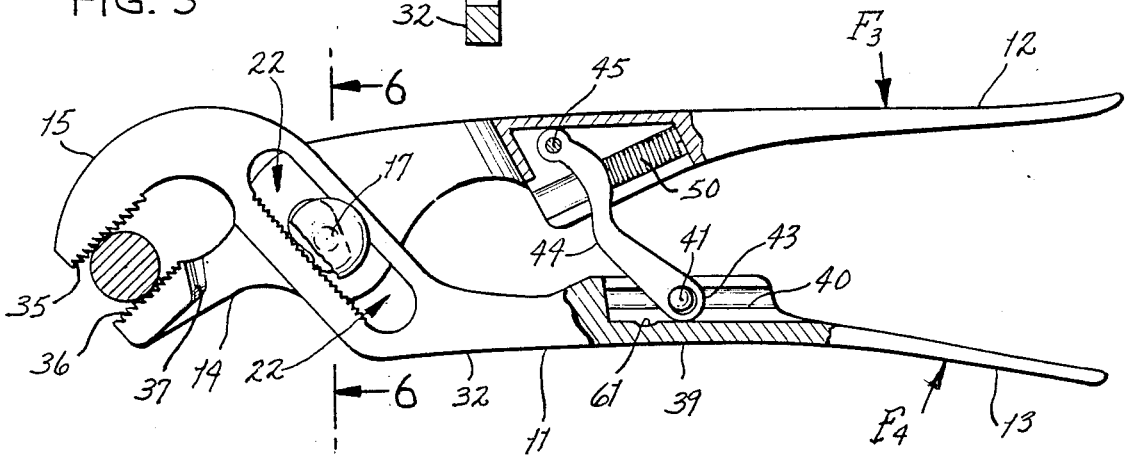

ADJUSTABLE PLIERS

BACKGROUND AND SUMMARY OF THE INVENTION

This invention relates to adjustable pliers and, more particularly, to precision pliers which provide precise self-locking engagement and automatic adjustment of jaw spacing for engagement of an object.

Various self-adjusting and self-locking tools have been heretofore known, for clamping, gripping, or otherwise providing adjusting of jaw configuration upon engaging an object such as a workpiece or fastening element. A matter of importance in the design of such tools is to provide a tool construction and design which provides easy, quick, reliable, and precise operation. If pliers are to be provided with self-adjusting jaws, there must be a mechanism for reliably and positively causing the jaws to cease their adjusting movement upon engagement of an object and to retain such position reliably so long as the pressure is maintained upon the tool by the user. In one type of construction, such as disclosed in U.S. Pat. No. 4,651,598, a pawl member is intended to provide interengagement of jaw portions by movement within a channel, one side of the channel defining a raceway and the other having a series of teeth to be engaged by the pawl. The pawl is formed with a pointed tip which, upon engagement of a workpiece by the jaw, is caused to engage one of the teeth. The pawl tip when so engaged is exposed to high compression and shear forces, such as to present the risk of its fracture and to heighten the potential for wear upon its surfaces and the teeth during use. These factors present potential either for compression or shear failure when extreme pressure is applied to the tool by a strong user or for slip failure in which the pawl tip slips from one tooth to the next. Therefore, it has previously been proposed to use multiple pawl teeth in self-adjusting pliers.

An additional aspect of concern in the design is for the tool to provide a desirable "feel," that is, tactile feedback through the user's hand when engaging an object. A pawl with single tip or tooth engagement as provided in the above-identified patent, provides only a limited adjustment due to the pitch of the teeth, which is large as a result of the single tip on the pawl. The geometry dictates that the number of teeth available for engagement is relatively limited so that, when tip engagement finally occurs, the handles of the tool may not be angularly spaced for comfort and to permit maximum application of force by the user's hand.

There are some situations of use where self-adjusting pliers have not satisfactorily operated because the pawl did not always reliably engage, e.g., when the tool is inverted (as when used underneath the work as is common in vehicle repair work), where gravity might tend to prevent pawl teeth engagement. Also, the tool is susceptible to lack of pawl engagement due to differing hand grip forces. In general, self-adjusting pliers of the prior art have had no satisfactory means for ensuring controlled pawl engagement. Prior designs have used extra springs for exerting forces on a control arm in such pliers, but this is more complicated, less reliable and more expensive.

A significant concern in the design of self-adjusting, self-locking pliers is to be able to manufacture the pliers economically. Heretofore, designs for self-adjusting pliers have not been suited for being manufactured by the use of forged, single-piece elements. Thus, it has been proposed variously to use laminated, riveted handle pieces, clamshell handle elements, and other unsatisfactory constructions for enclosing various springs. Handle designs in such prior art tools are not commercially satisfactory, and their inability to use forgings compromises not only cost but deprives the tool of the inherent strength of forgings.

Accordingly, among the several objects of the invention may be noted the provision of an adjustable pliers which provides precise automatic jaw adjustment to permit one-handed operation by the user with reliable self-looking establishment of jaw position upon engaging an object with slip-free engagement of an object providing optimum angular spacing between its handles; which includes a precision locking pawl which establishes a jaw relationship upon gripping of an object with positive locking engagement of the jaws, in which multiple teeth of the pawl positively engage multiple teeth of a rack carried by one jaw-defining member; which includes means for ensuring controlled pawl engagement of the rack teeth, so as to ensure pawl engagement upon the jaws contacting an object under all conditions of use; which provides superior "feel" by tactile feedback to the hand of the user upon gripping engagement of an object in its jaws; which is inherently resistant to wear by reducing the contact pressure of the pawl teeth with those of the rack so as not only to avoid wear but also to avoid change in dimensional relationships which otherwise may sacrifice reliability and long life of the pliers; which permits the use of one piece forged handle-defining members for strength and economy; which provides a superior handle configuration permitting maximization of the gripping force by one-handed operation of the user; and which is easily and economically manufactured with high, repeatable degree of precision.

Other objects of the invention will be in part apparent and in part pointed out hereinbelow.

BRIEF DESCRIPTION OF THE DRAWINGS

FIG. 1 is a side elevation view, partially taken in vertical cross-section, illustrating a self-adjusting pliers with the jaws in the full open position in accordance with and embodying the present invention.

FIG. 2 is a transverse cross-section of handle portions taken along line 2—2 of FIG. 1.

FIG. 3 is a transverse cross-section illustration of portions of another handle taken along line 3—3 of FIG. 1.

FIG. 4 is a side elevation view like that of FIG. 1 showing the self adjusting pliers with jaws just contacting a workpiece.

FIG. 5 is a side elevation view of the plier, partially taken in vertical cross section, in object-gripping, pawl-locked orientation maintained by pressure on the handle exerted by the user.

FIG. 6 is a transverse cross-section taken along line 6—6 of FIG. 5.

DESCRIPTION OF THE PREFERRED EMBODIMENT

Referring to the drawings, reference character A generally indicates a self-locking, automatically adjustable pliers. The term "self-locking" means that the jaws, which automatically adjust in size to accommodate the size of an object to be gripped, upon engaging an object, are precisely locked in pivotal relationship as the user increases force on the handles, in addition to the force required for sliding adjustment of the jaws.

Pliers A include interengaged pincers-forming members 10, 11 of strong forged tool-grade steel or alloy having high tensile strength with corresponding rigidity. Members 10, 11 include respective handle-forming portions 12, 13 and jaw-forming portions 14, 15, and central body portions 39, 47.

Members 10, 11 are connected or secured together for both sliding and pivoting motion between them. They are pivotally interengaged by a bolt 16 including a domed head 17 (FIG. 6). The bolt is secured with a predetermined degree of tightness, for movement of member 11 relative to member 10, by a locking nut 18. Other fastening means may be used in place of bolt 16, whose shaft extends through a circular opening 20 in member 10, and which opening is sized for fitting closely about bolt 16. A slotted opening 22 is provided in a jaw-forming shank portion 23 of member 11, said opening or slot 22 being elongated and substantially perpendicular to jaw 15 and aligned with the shank-forming portion 23 to permit pivoting as well as sliding of member 11 relative to member 10.

Slot 22 includes opposed ends 24, 25 of semicircular shape, a rectilinear smooth bearing surface 27 along a jaw-remote side, and a toothed portion 28 along the jaw-proximate side to include a relatively large number of closely and evenly pitched locking teeth 29 which extend along the rectilinear side of slot portion 28. The pitch of teeth 29 may, for example, be about 17–18 teeth per inch. In effect, portion 28 defines a rack or ratchet, in that said teeth 29 are uniformly spaced along its length, and are intended to be engaged by a precision pawl 30 which is rotatably affixed on the shank of bolt 16 within slot 22 for shifting in a manner to be explained. The operation of pawl 30 in connection with self-locking operation to provide automatic adjustment of pliers A is explained below, but pawl 30 will be noted as having locking teeth 31 for this purpose.

Shank portion 23 forms an angle of about 50 degrees with a central body portion 32 of member 11 from which extends handle portion 13 in outwardly flaring relationship. Similarly, member 10 includes a central body portion 33 from which its handle portion 12 extends in outwardly flaring relationship. Jaw-forming portion 15 of member 11 extends forwardly at substantially a right angle to shank portion 23, and includes jaw teeth 35 which are saw-toothed in configuration and "point" toward shank portion 23. Similarly, jaw-forming portion 14 of member 10 includes jaw teeth 36 which are saw-toothed in configuration and "point" away from central portion 33. Thus teeth 35 and teeth 36 point in opposite directions. By saw-toothed is meant that one side surface of a tooth is substantially perpendicular to the "contact line" formed by the crowns of the teeth and the other side surface of a tooth is at an acute angle to the "contact line". Said jaw-forming portion 14 extends at an angle of about 30 degrees to the generally longitudinal extent of main body portion 33.

Main body portion 32 of member 11 includes dimensionally enlarged central body section 39 having machined within it a groove 40, including a recessed floor groove 60, both of which extend longitudinally of central portion 32 for receiving a guide ball 41 which is located within an apertured outer end 43 of a doglegged control arm 44. The control arm 44 shown in FIG. 1 has two doglegs, the first dogleg being forwardly oriented and the second dogleg being rearwardly oriented when viewed from pivot pin 45. The first dogleg is formed by a curved portion which is convex toward handle 12. The second dogleg is formed by a curved portion which is concave toward handle 12. The outer tip of arm end 43 rides in groove 60, while groove 40 supports and contains ball 41 for movement and retaining outer end 43 of arm 44, which for this purpose has an upper end pivoted by a pin 45 within a slot 46 machined in enlarged central body portion 47 of member 10. Groove 40 opens through a slot 42 so that arm end 43 is captive and slideable relative to body portion 39 by captive movement of ball 41 within groove 40 away from the jaws as an object is gripped. Arm 44 is free to pivot about pin 45 upon movement of handle portions 12, 13 toward and away from each other. A cylindrical recess 49 is formed in portion 47 for receiving a coiled compression spring 50 which provides a biasing means and bears against an inner end 52 of the recess 49 for biasing said arm 44 about pin 45 in the opposite direction, i.e., toward the jaws, for purposes set forth below.

The forward end of grooves 40, 60 open into a recess 61 which is sized for permitting outer end 43 of control arm 44 to drop slightly from the recessed floor 60 of groove 40 in order to define a detent position for outer end 43 of arm 44 and thereby to define means for providing and ensuring controlled pawl engagement.

Normally, spring 50 causes arm 44 to be urged forward into said detent position, in which the arm is stable, so that the angle between control arm 44, as defined by a line between the center of pivot pin 45 and the center of guide ball 41, such line sometimes being referred to as the longitudinal axis of control arm 44, and the main body portion 32 is about 65 degrees when the pliers is in its opened, normal position, but this angle will decrease as the jaws are closed on an object.

Also note that the angle between the longitudinal axis of control arm 44 and the longitudinal axis through handle 12 (such axis being that axis which passes through the handle and the center of pivot pin 45) is in the range of 75 degrees to 85 degrees, and being preferably about 82 degrees, when the pliers is in its opened, normal position shown in FIG. 1; and such angle is in the range of 30 degrees to 38 degrees, and being preferably about 34 degrees, when the pliers is in the jaws fully closed upon a minimal thickness work object and gripping position. Thus such angle varies between about 85 degrees and 30 degrees during use of the pliers.

Locking pawl 30 is provided with its locking teeth 31 along a jaw-proximate side of the pawl and adjacent to teeth 31 is a rounded camming surface 54 such that teeth 31 are in the lower portion of the pawl and camming surface 54 is in the upper portion of the pawl relative to the shank of bolt 16. Along on a jaw-remote side of the pawl there is provided a reaction surface 55 which extends substantially the length of the pawl. Such surface 55 is thus opposite from teeth 31 and, being smooth, is intended to bear in sliding relationship against the jaw-remote surface 27 of the slot as the jaws close. The bottom of the pawl is preferably curvilinear and the pivot point of the pawl is below the midpoint of the longitudinal axis of the pawl, as shown in FIG. 1.

In the orientation shown in FIG. 1, reaction of spring 50 against control arm 44, located in its detent position, causes member 10 to shift relatively to the right with respect to member 11, causing surface 55 of pawl 30 to be maintained against the inner surface 27 of the slot. Thus, pincer 11 is urged forwardly and upwardly with respect to pincer 10, locking teeth 31 are out of engagement with rack teeth 29 so that the jaws remain unlocked, and reaction surface 55 of pawl 30 is in slideable contact with bearing surface 27 of slot 22; whereupon release of handles 12, 13, the pliers returns to its open, normal position. When the user squeezes handles 12, 13 with one hand, as indicated by forces $F_1$ and $F_2$, the jaws will close upon the object, as shown in FIG. 4, until it is contacted by the jaws.

FIG. 4 shows the relationship of the pliers when an object has just been contacted and a small amount of added force applied, the jaws 14, 15 are in contact with an object to be gripped, the pawl 30 has rotated so its teeth 31 are engaged with teeth 29 of rack 28 and the control arm end 43 is still in the recess 61, recess 61 providing a detent for control arm end 43. Additional force on the handle portions will disengage control arm end 43 from recess 61.

Jaw contact with a work object and the apertured end 43 of the control arm 44 being located in recess 61, which recess provides a detent and retards sliding movement of end 43, and added closing force on the handle portions causes relative shifting movement of members 10, 11, for bringing pawl camming surface 54 into contact with rack teeth 29, causing the pawl 30 to rotate about shank 16 for bringing pawl teeth 31 into positive locking engagement with rack teeth 29. The recess 61 provides an interference with sliding motion of end 43 of control arm 44. This interference is necessary on when the control arm 44 is in its normal, pliers-open, position. This establishes a locking engagement with the rack for maintaining the jaws in locked, object-contacting relationship so long as user handle pressure is maintained. After pawl 30 rotates and teeth 31 engage teeth 29, additional closing force on the handles 12, 13 causes outer end 43 to be displaced from recess 61, which is a detent. Therefore, detent recess 61 which receives a portion of the pivot remote end of 43 of control arm 44 serves as interference means providing such interference.

Pawl teeth 31 are provided with the same pitch as rack teeth 29. Consequently, several locking teeth are interengaged with several teeth of the rack at any occasion in which the pawl provides such locking engagement. This causes the locking forces to be distributed among several teeth and reduces wear as well as insuring that no single tooth or point of contact will be relied upon for maintaining jaw position.

Since recess 61 causes detenting of outer end 43 of control arm 44, pincer member 10 is biased forwardly, i.e., to the left, with respect to pincer member 11 due to spring 50 and control arm 44 and thus reaction surface 55 of pawl 30 is held against slot surface 27 and out of rack engagement when jaws 14, 15 are not in contact with a work object. But when jaws 14, 15 contact a work object and the pawl has rotated so teeth 31 engage teeth 29, an additional force on the handles, shown in $F_3$ and $F_4$ in FIG. 5, causes outer end 43 to jump from its detented position and then shift rearwardly along groove 40 whereby a work object can be gripped tightly between the jaws. Slight resistance will be felt as the handles are initially squeezed. In this way, controlled pawl engagement is provided when the user exerts force to grip the object.

FIG. 5 demonstrates the inherent capability of self-locking pliers of this invention to accommodate an object of a small size, with reliable gripping of the object being maintained so long as the handles are squeezed by the user, which applies forces as indicated by directionals in this illustration.

In view of the foregoing it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. An adjustable plier for providing automatic jaw adjustment for gripping objects of different sizes, comprising first and second pincers-defining members each having a jaw portion, a central body portion, and a handle portion, securement means for joining the central body portions of the first and second members in pivotal, mutually moveable relationship, to provide jaws in opposed relation for providing gripping of an object upon squeezing together of the handle-defining portions by user hand pressure, the first member including a slot through which extends the securement means, the slot permitting pivoting as well as sliding movement of the first member relative to the second member, a locking pawl carried shiftably by the securement means within the slot and having on a jaw-proximate side a plurality of locking teeth, and on a jaw-remote side a smooth reaction surface opposite from its teeth, the slot having along a jaw-proximate side a rack of teeth to be engaged by the locking teeth of the pawl, the slot having a jaw-remote side of the slotted opening providing a smooth surface for sliding engagement of the reaction surface of the locking pawl, a control arm pivotally engaged at one end to the central body portion of one of the members, the central body portion of the other member receiving the other end of the control arm in slidable relationship, means for resiliently biasing the control arm for movement about its pivoted end toward the jaws, and interference means for providing controlled pawl engagement of the rack, whereby the control arm initially causes the locking pawl reaction surface to bear against the jaw-remote side of the slot, so that handle squeezing causes jaw-closing movement of the jaws until they contact an object, such jaw contact with an object causing the pivot-remote end of the control arm to shift in a direction away from the jaws for causing shifting of the pawl within the slot for forcing its locking teeth into locking engagement with the rack teeth for maintaining the jaws in locked, object-contacting relationship while user handle pressure is maintained, said interference means for providing controlled pawl engagement comprising detenting means for detenting the control arm in an initial position, said one end of the control arm being pivotally connected to one of said members and the pivot-remote end being guided in a groove formed in the other of said members for controlling shifting therein of the pivot-remote end, and the detenting means comprising a recessed portion of said groove receiving the pivot-remote end of the control arm for establishing a controlled initial position of the control arm.

2. Pliers according to claim 1 wherein the locking pawl is rotatable within the slot for alternative disengagement from or engagement with the locking teeth of the rack, the shifting of the control arm in response to said jaw contact causing the pawl to rotate for effecting engagement of its locking teeth with the rack.

3. Pliers according to claim 2 wherein the locking pawl includes a camming surface on its jaw-proximate side adjacent to the locking teeth, the shifting of the control arm bringing the camming surface into contact with the rack, thereby rotating the pawl to cause engagement of its locking teeth with the rack.

4. Pliers according to claim 3 wherein the locking teeth and rack teeth have the same pitch.

5. Pliers according to claim 4 wherein said pitch is about 17–18 teeth per inch.

6. Pliers according to claim 1 wherein the control arm is pivotally engaged at said one end to the second member, the central body portion of the first member receiving the pivot remote end of the control arm in slidably captive relationship.

7. Pliers according to claim 6 wherein the slidably captive relationship is provided by means including a groove in the main body portion of the first member, a ball slidable in the groove, and an aperture in the pivot remote end of the control arm for receiving the ball.

8. Pliers according to claim 7 wherein the groove includes a detent for receiving said ball and pivot remote end whereby to provide a detented initial portion of the control arm, whereby said detent provides said means for providing controlled pawl engagement.

9. Pliers according to claim 1 wherein the means resiliently biasing comprises a coiled compression spring, the main body portion of the second member defining a recess for the compression spring.

10. Pliers according to claim 8 wherein the jaw proximate portion of the central body portion of the first member provides a shank between its jaw and handle portion.

11. Pliers according to claim 9 wherein the shank defines an angle with the handle-proximate central body portion of about 50 degrees.

12. An improvement in a self-adjusting pliers having (1.) a first and second pincer member, each member having a jaw portion and a central portion and a handle portion, (2.) securement means for connecting the pincer members in an initially slideable and then pivotable relationship, (3.) the securement means including a slot in said first member in the jaw-proximate portion of its central portion, the longitudinal axis of the slot being at a significant angle to the jaw portion of said first member, the slot having multiple teeth on its longitudinal surface nearest the jaw portion, the longitudinal surface of the slot distal from the jaw portion being smooth, (4.) the securement means also including a pawl positioned within the slot, the pawl being pivotably mounted, the pawl having multiple teeth located on the lower portion of its jaw-proximate longitudinal surface, (5.) biasing means coacting between the two members for urging one member forwardly with respect to the other member, (6.) the biasing means including a control arm, one end of the control arm being pivotally connected to the central portion of said one member, the pivotal connection being located distally from the securement means, (7.) connecting means associated with the central portion of the other member for maintaining the other end of the control arm in contact with and slideable with respect to said other member, (8.) whereby an initial manual closing force on the handle portions causes the jaw portions to move toward each other in sliding motion; the improvement comprising: interference means associated with the biasing means to initially resist sliding motion of said other end of the control arm with respect to said other member, whereby upon initial gripping of a work piece between the jaw portions and the application of an additional closing force on the handle portions, the slideable relationship of the securement means ceases and the forward bias of said one member is changed to a rearward bias and the teeth of the pawl engage the teeth of the slot so that the securement means positively changes from slideable to pivotable and the interference means is overcome so that said other end of the control arm is in free sliding relationship with said other member and the work piece can be securely gripped within the opposing jaw portions, said connecting means including a groove in said central portion of the member, the longitudinal axis of the groove being aligned with the longitudinal axis of the central portion, the end of the groove closest to the jaw portion being its proximal end, said other end of the control arm being located within and being slideable within the groove, and the interference means comprising a detent in the groove near the proximal end of the groove.

13. The improvement of claim 12 including teeth on each jaw portion, the teeth on one jaw portion being disposed in opposition to the teeth on the other jaw portion, the teeth on each jaw portion being a saw tooth configuration and the teeth on one jaw portion being pointed toward the central portion on that member and the teeth on the other jaw portion being directed away from the central portion of the other member, whereby a work piece will be gripped by the teeth.

14. The improvement of claim 12 wherein the lower surface of the other end of the control arm is curvilinear and the detent is a recess in the bottom surface of the groove.

15. The improvement of claim 12 wherein the angle between the longitudinal axis of the control arm, and the longitudinal axis through the handle portion of said one member when the pliers is in its open-normal position, is in the range of 75 degrees to 85 degrees.

16. The improvement of claim 15 wherein said angle is about 82 degrees when the pliers is in its open-normal position.

17. The improvement of claim 31 wherein said one member to which the control arm is pivotally connected is said second member.

18. The improvement of claim 15 wherein the distance between the normal position of the center of said other end of the control arm and the normal position of the pivot axis of the pawl is greater than the distance between the pivot axis of said one end of the control arm and the normal position of the pivot axis of the pawl.

19. The improvement of claim 18 wherein the control arm has a portion proximal its pivot point, which portion is convex toward the handle portion.

20. The improvement of claim 19 wherein the control arm has a portion distal from its pivot point, which portion is concave toward the handle portion.

21. The improvement of claim 19 wherein said biasing means includes a spring means located within the central portion of said one member, said spring means operating on the convex portion of the control arm to urge the other end of the control arm forwardly about the pivot point of the control arm toward the jaw portions and toward the normal position of said control arm.

22. The improvement of claim 12 wherein the pivot axis of the pawl is below the midpoint of the longitudinal axis of the pawl.

23. An improvement in a self-adjusting pliers having (1.) a first and second pincer member, each member having a jaw portion and a central portion and a handle portion, (2.) securement means for connecting the pincer members in an initially slideable and then pivotable relationship, (3.) the securement means including a slot in said first member in the jaw-proximate portion of its central portion, the longitudinal axis of the slot being at a significant angle to the jaw portion of said first member, the slot having multiple teeth on its longitudinal surface nearest the jaw portion, the longitudinal surface of the slot distal from the jaw portion being smooth, (4.) the securement means also including a pawl positioned within the slot, the pawl being pivotably mounted, the pawl having multiple teeth located on the lower portion of its jaw-proximate longitudinal surface, (5.) biasing means coacting between the two members for urging one member forwardly with respect to the other member, (6.) the biasing means including a control arm, one end of the control arm being pivotally connected to the central portion of said one member, the pivotal connection being located distally from the securement means, (7.) connecting means associated with the central portion of the other member for maintaining the other end of the control arm in contact with and slideable with respect to said other member, (8.) whereby an initial manual closing force on the handle portions causes the jaw portions to move toward each other in sliding motion; the improvement comprising: interference means associated with the biasing means to initially resist sliding motion of said other end of the control arm with respect to said other member, whereby upon initial gripping of a work piece between the jaw portions and the application of an additional closing force on the handle portions, the slideable relationship of the securement means ceases and the forward bias of said one member is changed to a rearward bias and the teeth of the pawl engage the teeth of the slot so that the securement means positively changes from slideable to pivotable and the interference means is overcome so that said other end of the control arm is in free sliding relationship with said other member and the work piece can be securely gripped within the opposing jaw portions, the angle between the longitudinal axis of the control arm, and the longitudinal axis through the handle portion of said one member when the pliers is in its open-normal position, being in the range of 75 degrees to 85 degrees, said connecting means including a groove in said central portion of the member, the longitudinal axis of the groove being aligned with the longitudinal axis of the central portion, the end of the groove closest to the jaw portion being its proximal end, said other end of the control arm being located within and being slideable within the groove, and the interference means comprising a detent in the groove near the proximal end of the groove, the lower surface of said other end of the control arm being curvilinear and the detent comprising a recess in the bottom surface of the groove.

24. An adjustable plier for providing automatic jaw adjustment for gripping objects of different sizes, comprising first and second pincers-defining members each having a jaw portion, a central body portion, and a handle portion, securement means for joining the central body portions of the first and second members in pivotal, mutually moveable relationship, to provide jaws in opposed relation for providing gripping of an object upon squeezing together of the handle-defining portions by user hand pressure, the first member including a slot through which extends the securement means, the slot permitting pivoting as well as sliding movement of the first member relative to the second member, a locking pawl carried shiftably by the securement means within the slot and having on a jaw-proximate side a plurality of locking teeth, and on a jaw-remote side a smooth reaction surface opposite from its teeth, the slot having along a jaw-proximate side a rack of teeth to be engaged by the locking teeth of the pawl, the slot having a jaw-remote side of the slotted opening providing a smooth surface for sliding engagement of the reaction surface of the locking pawl, a control arm pivotally engaged at one end to the central body portion of one of the members, the central body portion of the other member receiving the other end of the control arm in slidable relationship, means for resiliently biasing the control arm for movement about its pivoted end toward the jaws, and interference means for providing controlled pawl engagement of the rack, whereby the control arm initially causes the locking pawl reaction surface to bear against the jaw-remote side of the slot, so that handle squeezing causes jaw-closing movement of the jaws until they contact an object, such jaw contact with an object causing the pivot-remote end of the control arm to shift in a direction away from the jaws for causing shifting of the pawl within the slot for forcing its locking teeth into locking engagement with the rack teeth for maintaining the jaws in locked, object-contacting relationship while user handle pressure is maintained, the interference means for providing controlled pawl engagement comprising means for detenting the control arm in an initial position, said detenting means including a detent in the main body portion of the first member, and a portion of the pivot-remote end of the control arm being received in the detent for detented engagement of the pivot remote end so as to provide resistance to shifting movement of the pivot-remote end from detented engagement in the detent.

* * * * *

UNITED STATES PATENT AND TRADEMARK OFFICE

CERTIFICATE OF CORRECTION

PATENT NO. : 4,922,770

DATED : May 8, 1990

INVENTOR(S) : Andrzej J. Dlugolecki, Timm R. Herman

It is certified that error appears in the above-identified patent and that said Letters Patent is hereby corrected as shown below:

Col. 8, line 56, replace "31" with --12--.

Signed and Sealed this

Twentieth Day of August, 1991

*Attest:*

HARRY F. MANBECK, JR.

*Attesting Officer*

*Commissioner of Patents and Trademarks*